US012686956B2

(12) United States Patent
Münster et al.

(10) Patent No.: US 12,686,956 B2
(45) Date of Patent: Jul. 21, 2026

(54) METHOD FOR OPERATING A CRIMPING APPARATUS, AND CRIMPING APPARATUS

(71) Applicant: Oerlikon Textile GmbH & Co. KG, Remscheid (DE)

(72) Inventors: Uwe Münster, Wilster (DE); Martin Rucker, Kiel (DE)

(73) Assignee: OERLIKON TEXTILE GMBH & CO. KG, Remscheid (DE)

( * ) Notice: Subject to any disclaimer, the term of this patent is extended or adjusted under 35 U.S.C. 154(b) by 633 days.

(21) Appl. No.: 17/299,178

(22) PCT Filed: Oct. 2, 2019

(86) PCT No.: PCT/EP2019/076717
§ 371 (c)(1),
(2) Date: Jun. 2, 2021

(87) PCT Pub. No.: WO2020/114648
PCT Pub. Date: Jun. 11, 2020

(65) Prior Publication Data

US 2022/0034000 A1 Feb. 3, 2022

(30) Foreign Application Priority Data

Dec. 4, 2018 (DE) ..... 10 2018 009 465.1

(51) Int. Cl.
*D02G 1/12* (2006.01)

(52) U.S. Cl.
CPC ..... *D02G 1/125* (2013.01)

(58) Field of Classification Search
CPC ..... D02G 1/125; D02G 1/12–1/127
USPC ..... 28/221, 262–270
See application file for complete search history.

(56) References Cited

U.S. PATENT DOCUMENTS 3,600,776 A * 8/1971 Aoki ..... D02G 1/12 28/269
3,618,183 A * 11/1971 Funk et al. ..... D02G 1/12 28/269
3,800,373 A * 4/1974 Fleissner ..... D02G 1/12 28/248
4,115,908 A * 9/1978 Saxon ..... D02G 1/12 28/269

(Continued)

FOREIGN PATENT DOCUMENTS

DE 3621479 A1 1/1988
DE 19537958 C1 11/1996
EP 0582129 B1 * 9/1997 ..... D02G 1/12

*Primary Examiner* — Clinton T Ostrup
(74) *Attorney, Agent, or Firm* — BainwoodHuang

(57) ABSTRACT

Techniques are directed to operating a crimping apparatus, and to a crimping apparatus for crimping a fibre strand having at least two driven rollers and a stuffer box. A nip is formed between the rollers and is sealed off at the end faces of the rollers by press plates. The press plates at the start of the process are temporarily actively pressed against the end faces of the rollers by press actuators, and, once a contact position has been reached, are held in place by generation of a clamping force by clamping actuators. Each press plate, in addition to a press actuator, is thus also associated with a clamping actuator for clamping of the press plate, the press actuators and clamping actuators being controllable by at least one control unit.

13 Claims, 5 Drawing Sheets

(56) References Cited

U.S. PATENT DOCUMENTS

Figure 1:
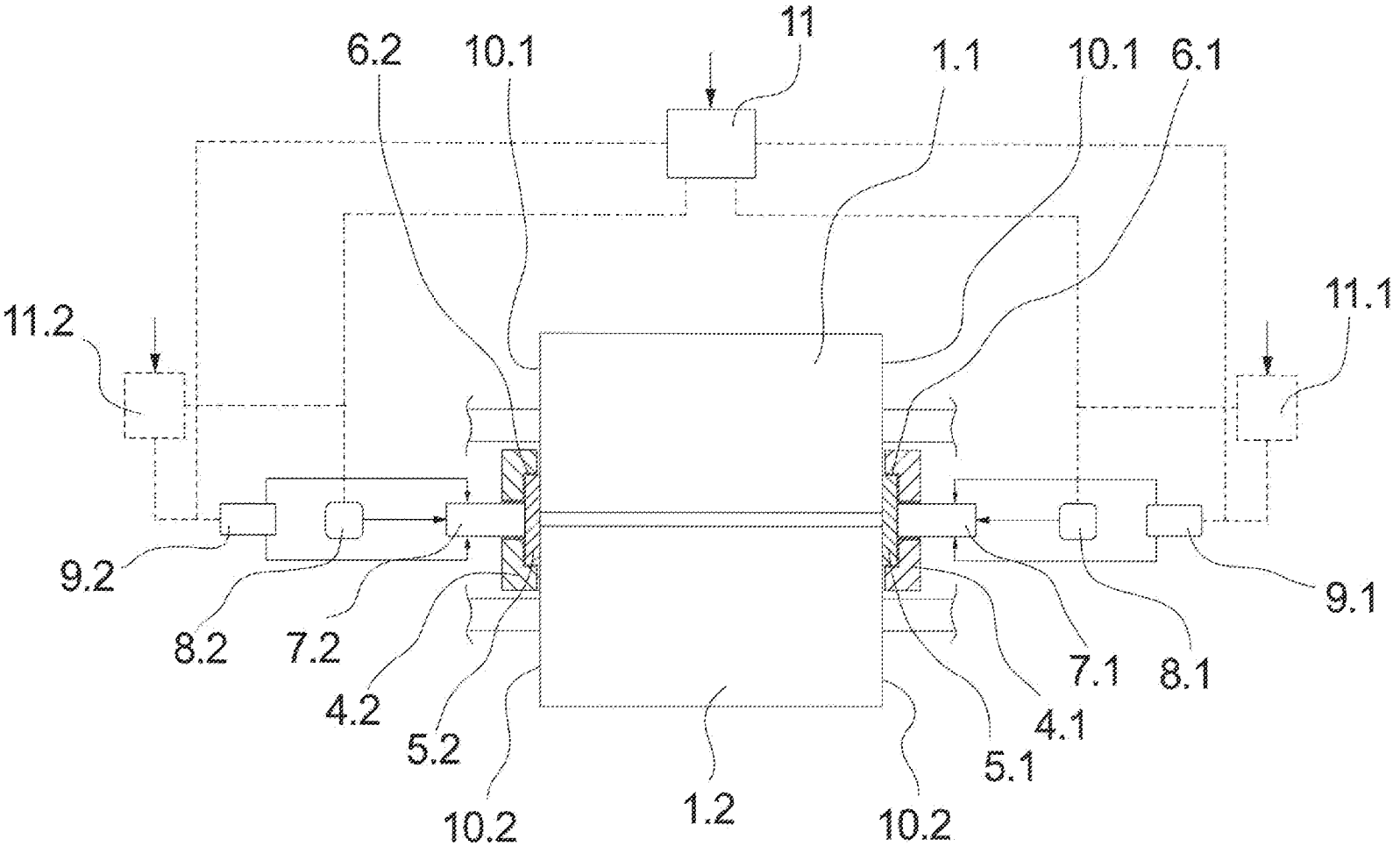

| | | | | | |
|---|---|---|---|---|---|
| 4,807,337 | A * | 2/1989 | Fleissner | D02G 1/125 | 28/248 |
| 5,673,466 | A * | 10/1997 | Fleissner | D02G 1/12 | 28/269 |
| 5,778,502 | A * | 7/1998 | Voigtlander | D02G 1/12 | 28/269 |
| 7,278,191 | B1 * | 10/2007 | Lane | D02G 1/12 | 28/264 |

* cited by examiner

METHOD FOR OPERATING A CRIMPING APPARATUS, AND CRIMPING APPARATUS

The invention relates to a method for operating a crimping device as disclosed herein, as well as to a crimping device for crimping a fibre strand as disclosed herein.

Crimping devices of this type are particularly used in the production of staple fibres. Prior to a fibre strand being cut, the fibres of the fibre strand are imparted a crimp. To this end, the fibres of the fibre strand are guided through a roller gap which is configured between two driven rollers. The roller gap is followed by a so-called stuffer box in which the fibres of the fibre strand are conveyed. In order to prevent fibres laterally exiting the roller gap at the end sides of the rollers, the roller gap at the end sides of the rollers is in each case sealed by one compression plate. It is commonplace herein for the compression plates to be in each case pressed against the end sides of the rollers by way of a contact pressure force. By virtue of the relative movement between the rollers and the compression plates, evidence of wear as well as metallic abrasion which is picked up by the fibres and is thus undesirable inevitably arise.

In order for metallic abrasion of this type to be avoided, a crimping device in which the compression plates are held on the end sides of the rollers by means of a compression actuator and wherein a superimposed rotary drive leads to a rotation of the compression plates is known from DE 195 37 958 A. Despite said rotation of the compression plates, wear on account of the compression plates which by way of a compressive load bear on the end sides of the rollers is possible. Moreover, a heat generation which leads to a rise in the temperature of the adjacent fibre strands is to be observed on account of the relative movements between the compression plates and the end sides of the rollers. The friction which is required for the wear and the heating is also not substantially reduced on account of the rotation of the compression plates since the speed vectors of the compression plates and of the end sides of the rollers are not oriented in identical directions.

In principle, other crimping devices in which a defined sealing gap is set between the end sides of the rollers and the compression plate are also known in the prior art. For example, a crimping device in which the compression plates are in each case disposed on the end plates of the rollers by way of a side plate having a predefined sealing gap is thus known from DE 102 43 203 A1. The sealing gap herein can be set by way of a fixing means. However, pre-set sealing gaps of this type between a compression plate and the end sides of the rollers have the fundamental disadvantage that individual filaments of the fibre strands can be pressed into the sealing gaps. To this extent, wear between the compression plates and the rollers is indeed avoided however with the disadvantage that fibres from the roller gap can be pressed into the sealing gaps.

It is now an object of the invention to achieve a method for operating a crimping device as well as a generic crimping device by means of which the crimping of a fibre strand takes place in such a manner that ideally no wear arises and ideally no sealing gaps are created between the rollers and the compression plates.

This object is achieved according to the invention by a method for operating a crimping device as disclosed herein, and by a crimping device as disclosed herein.

Advantageous refinements of the invention are defined by the respective features and combinations of features disclosed herein.

The invention has the particular advantage that no contact pressure force acts between the compression plates and the end sides of the rollers in the operation of the crimping device. The compression plates are fixed directly by clamping in a bearing position in which almost no sealing gap is present. To this end, the compression plates at the start of a process are briefly pressed onto the end sides of the rollers and upon reaching a bearing position are held by a clamping force. To this end, the crimping device per compression plate has in each case one separate clamping actuator for clamping the compression plates, said clamping actuator being capable of being controlled conjointly with the compression actuators by at least one control apparatus. The compression actuators can thus be deactivated upon activating the clamping actuators which establish the compression plates in the respective bearing positions of the latter. The pressing of the compression plates onto the end sides of the rollers when in operation is thus dispensed with.

To this end, the compression plates by way of a radially acting clamping force are clamped in such a manner that the compression plates remain in the bearing position when in operation. To this end, the compressive forces generated on account of the fibre strand in the interior of the roller gap are to be absorbed by the clamping forces on the compression plates.

In order for the faces of the compression plates to be able to be utilized uniformly for sealing the sealing gaps in relation to the end sides of the rollers, the method variant in which each of the compression plates is in each case connected to one rotary drive and in the bearing position carries out a superimposed rotation relative to the respective end side of the rollers is particularly advantageous. A homogenization of the load on the compression plate is thus achieved. To this end, the crimping device has rotary drives which are coupled to the compression plates such that the compression plates can be rotated relative to the end sides of the rollers.

In order to be able to guide the compression plates to the respective bearing positions, the method variant in which each of the compression plates by way of a pneumatically generated compression force is pressed axially onto the end sides of the rollers is preferably embodied. No great forces are required since the compressive forces which arise in the roller gap when in operation are absorbed solely by the clamping forces that act on the compression plates. The compressive force serves only for setting the gap-free compression plate position prior to the start of the process.

In order for relatively high clamping forces to be able to be generated, the compression plates by way of a hydraulically generated clamping force are preferably held radially in the bearing position. It is thus ensured that the compression plates remain in the bearing positions thereof during the operation of the crimping device. The sealing gaps that are potentially formed in operation depend exclusively on the material of the components and the Young's modulus thereof. In the extreme case, said sealing gaps must be only a few micrometers.

The setting of the compression plates and the fixing of the compression plates can preferably be implemented by a supporting piston which bears on an end side of one of the compression plates. The forces for setting the compression plates and for clamping the compression plates can thus be advantageously generated directly on the supporting piston by the compression actuator and the clamping actuator.

In order for a rotation of the compression plates to be enabled despite the clamping, the refinement of the crimping device in which the supporting pistons have in each case one rotary shaft portion, said shaft portions being connected in a rotationally fixed manner to the compression plates and being coupled to the rotary drives is preferably embodied. The supporting pistons can thus be connected to the shaft portions by way of a mounting which enables a transmission of the compressive forces.

To this extent, the crimping device according to the invention in the refinement in which one of the compression actuators acts axially and one of the clamping actuators acts radially on a supporting piston which bears on one of the compression plates is particularly advantageous. The compression actuator and the clamping actuator can thus be advantageously integrated in a functional unit which together with a supporting piston is assigned to the compression plates.

The compression actuator herein advantageously has a compressed-air supply, and the clamping actuator advantageously has a hydraulics supply.

The variant in which the compression actuator and the clamping actuator are configured so as to be integrated in one housing is particularly compact. The functional unit can thus also be advantageously operated in the rough environment of a fibre line.

The method according to the invention for operating a crimping device and the crimping device according to the invention thus offer the particular advantage that the fibre strands are capable of being crimped and guided with high uniformity also in the peripheral region of the roller gap.

The method according to the invention for operating a crimping device will be explained in more detail hereunder by means of an exemplary embodiment of the crimping device according to the invention with reference to the appended figures.

Figure 2:
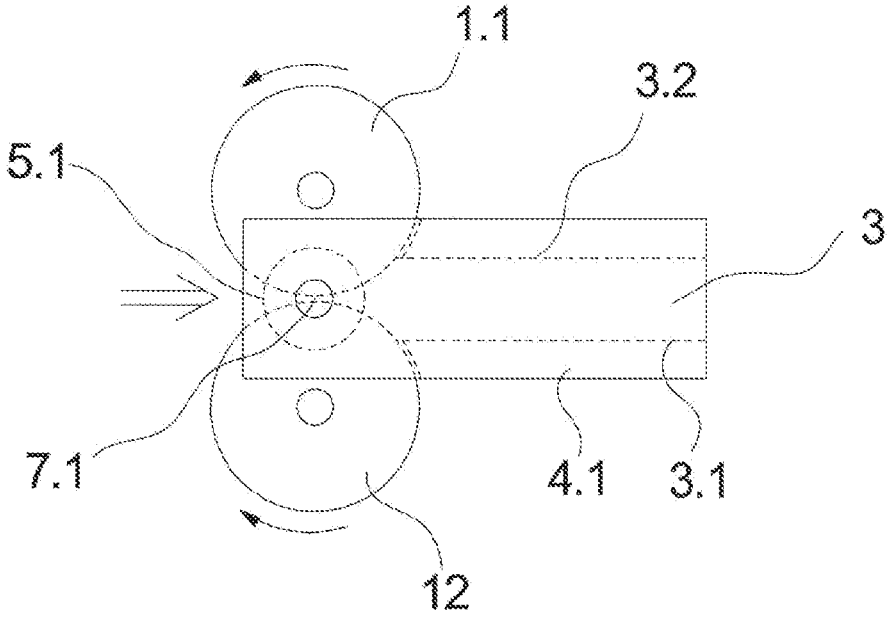
Figure 3:
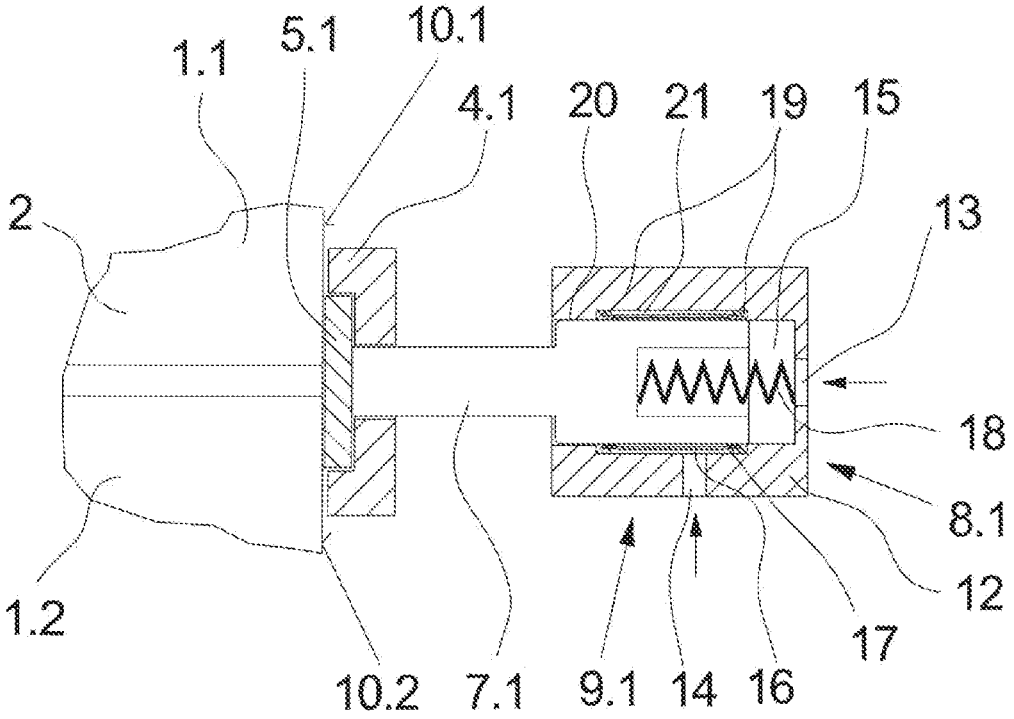
Figure 4:
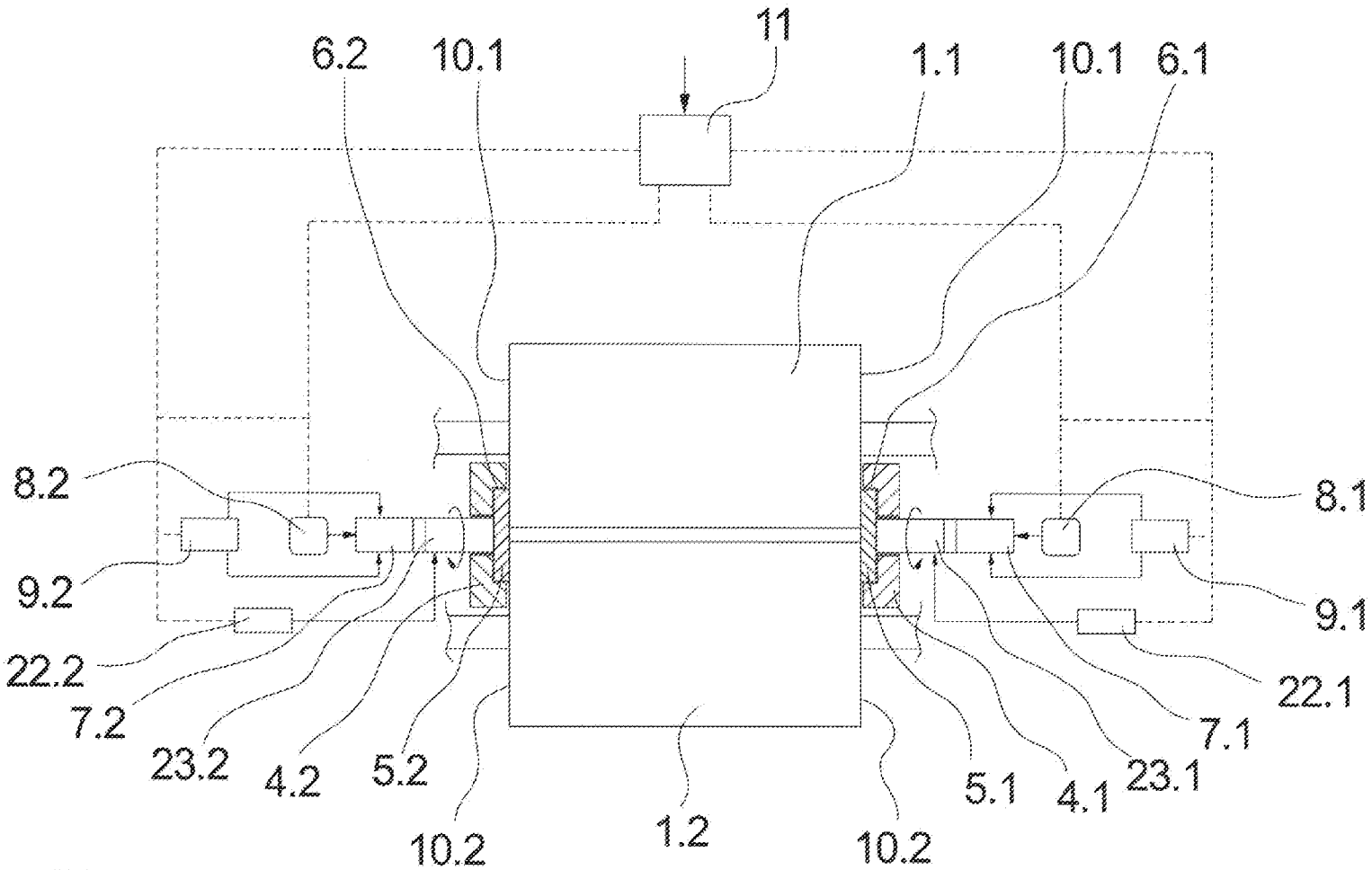
Figure 5:
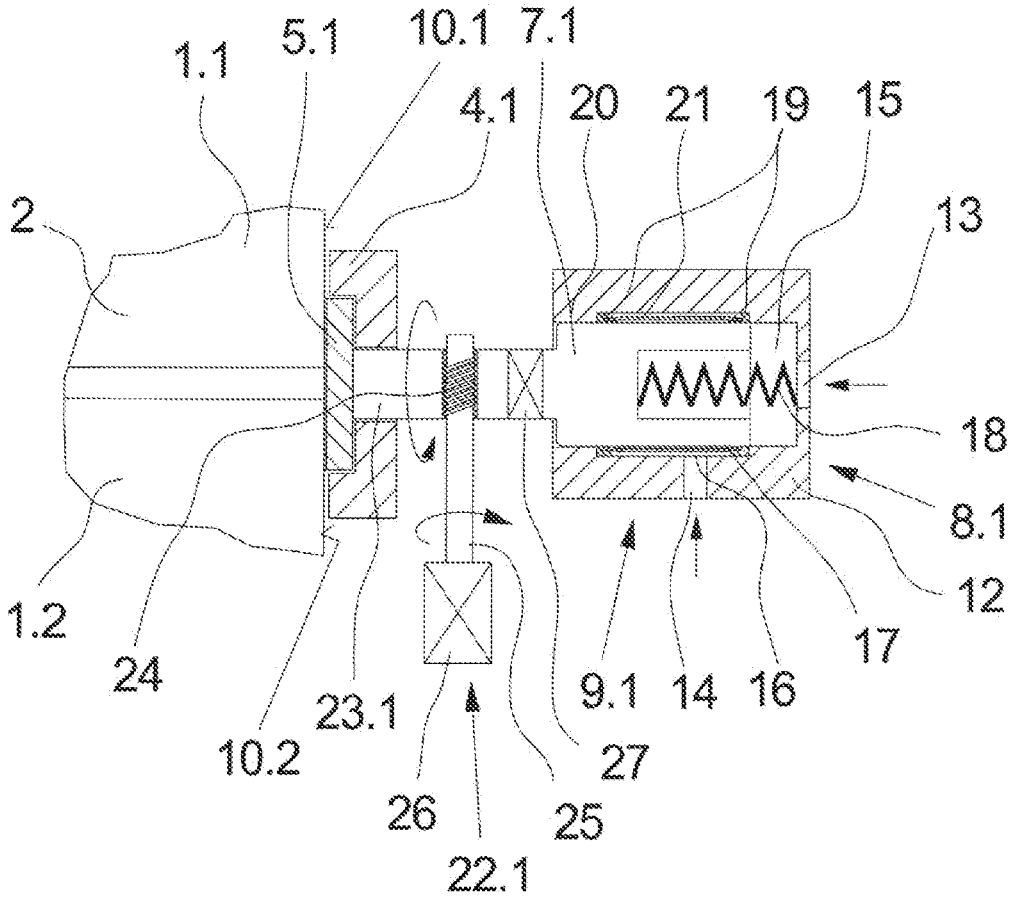

In the figures:

FIG. 1 schematically shows a front view of a first exemplary embodiment of a crimping device according to the invention;

FIG. 2 schematically shows a lateral view of the exemplary embodiment from FIG. 1;

FIG. 3 schematically shows a fragment illustration of a further exemplary embodiment of the crimping device according to the invention;

FIG. 4 schematically shows a front view of a further exemplary embodiment of a crimping device according to the invention; and FIG. 5 schematically shows a fragment illustration of a further exemplary embodiment of the crimping device according to the invention.

A first exemplary embodiment of the crimping device according to the invention is schematically illustrated in a plurality of views in FIGS. 1 and 2. FIG. 1 shows the exemplary embodiment in a front view, and a lateral view is shown in FIG. 2. Only those components of a crimping device that are relevant to the invention are illustrated herein.

The crimping device has two driven rollers 1.1 and 1.2 which are disposed in a machine frame (not illustrated here) and are driven by at least one motor (likewise not illustrated here). The rollers 1.1 and 1.2 therebetween form a roller gap 2.

As is illustrated in FIG. 2, a stuffer box 3 is assigned to the rollers 1.1 and 1.2 on an outlet side of the roller gap 2. The stuffer box 3 on both end sides of the rollers 1.1 and 1.2 is in each case delimited by one side plate 4.1 and 4.2. A base plate 3.1 and an upper plate 3.2 which therebetween form the box inlet of the stuffer box 3 so as to be parallel to the roller gap are disposed between the side plates 4.1 and 4.2. The base plate 3.1 and the upper plate 3.2 are assigned directly to the circumference of the rollers 1.1 and 1.2 on the entry side of the stuffer box 3.

As is derived in particular from the illustration in FIG. 1, the side plates 4.1 and 4.2 in the region of the roller gap 2 have in each case one compression plate 5.1 and 5.2. The compression plate 5.1 is set into the side plate 4.1 and is embodied so as to be axially movable. Accordingly, the compression plate 5.2 is embedded in the side plate 4.2. The side plates 4.1 and 4.2 to this end have in each case one machined recess 6.1 and 6.2. One supporting piston 7.1 and 7.2 for the axial adjustment of the compression plates 5.1 and 5.2 is in each case assigned to each of the compression plates 5.1 and 5.2. The supporting pistons 7.1 and 7.2 herein penetrate the side plates 4.1 and 4.2 and bear on the end sides on the compression plates 5.1 and 5.2.

A compression actuator 8.1 and a clamping actuator 9.1 act on a protruding end of the supporting piston 7.1. The compression actuator 8.1 and the clamping actuator 9.1 are connected by a control apparatus 11.

A second compression actuator 8.2 and a second clamping actuator 9.2 act on the free protruding end of the supporting piston 7.2 on the opposite side of the roller gap. The compression actuator 8.2 and the clamping actuator 9.2 likewise coupled to a control apparatus 11.

The compression actuators 8.1 and 8.2 as well as the clamping actuators 9.1 and 9.2 are only schematically illustrated in FIG. 1. Electric, pneumatic, or hydraulic compression actuators which generate a contact pressure force acting axially on the supporting pistons 7.1 and 7.2 can be used for the compression actuators 8.1 and 8.2. Accordingly, the clamping actuators 9.1 and 9.2 can be formed by electric, pneumatic, or hydraulic clamping elements which generate a clamping force that acts radially on the circumference of the supporting pistons 7.1 and 7.2.

In order for the crimping device illustrated in FIGS. 1 and 2 to be put into operation, the compression plates 5.1 and 5.2 are initially axially displaced in a synchronous manner by activating the compression actuators 8.1 and 8.2 by the control apparatus 11 and by way of a contact pressure force are guided to the end sides 10.1 and 10.2 of the rollers 1.1 and 1.2. As soon as the compression plates 5.1 and 5.2 have in each case reached the bearing position, the clamping actuators 9.1 and 9.2 are activated by way of the control apparatus 11 such that the supporting pistons 7.1 and 7.2 are in each case fixed in the momentary position thereof on the circumference by way of a clamping force. The compression plates 5.1 and 5.2 are thus held in the bearing position thereof on the end sides 10.1 and 10.2 of the rollers 1.1 and 1.2 by clamping. The compression actuators 8.1 and 8.2 are deactivated so that no contact force pressures act, and the compression plates 5.1 and 5.2 remain in the bearing position thereof without a contact pressure force. When in operation, fibre strands are now supplied to the rollers 1.1 and 1.2. The fibre strands are drawn through the rollers 1.1 and 1.2 into the roller gap 2 and guided into the adjacent stuffer box 3. High operating pressures within the roller gap which act against the compression plates 5.1 and 5.2 are created herein. To this extent, said compressive forces are absorbed by the clamping forces on the supporting pistons 7.1 and 7.2. No sealing gaps are created herein.

In the case of the crimping device schematically illustrated in FIG. 1, the compression actuators 8.1 and 8.2 as well as the clamping actuators 9.1 and 9.2 can advantageously also be controlled by separate control apparatuses which are illustrated by dashed lines and identified by the reference signs 11.1 and 11.2 in FIG. 1. The setting of the compression plates 5.1 and 5.2 and the clamping of the compression plates 5.1 and 5.2 can thus be carried out in a mutually independent manner on both end sides of the rollers 1.1 and 1.2.

The linking of the clamping actuators 9.1 and 9.2 and of the compression actuators 8.1 and 8.2 to the supporting pistons 7.1 and 7.2 is likewise exemplary. Depending on the embodiment of the compression actuators and clamping actuators, said compression actuators and clamping actuators could also act directly on the compression plates and be partially integrated in the side plates, for example.

However, it has proven successful in practice for the compression actuator and the clamping actuator to be integrated so as to form a functional unit in order to obtain an ideally compact construction mode on the crimping device. To this end, a cross-sectional view of a potential exemplary embodiment of the crimping device is illustrated in a fragment in FIG. 3. In the case of the exemplary embodiment shown in FIG. 3, the compression actuator 8.1 and the clamping actuator 9.1 are integrated in a housing 12. A supporting piston 7.1 is guided in a housing bore 20 in the housing 12. The housing bore 20 is closed at one end and connected to a compressed-air supply connector 13 that is configured on the housing 12. An air chamber 15 is configured within the housing bore 20 so as to be below the supporting piston 7.1. A return spring 18 is clamped in the interior, between the supporting piston 7.1 and the housing 12.

A collet 17 is held within the housing 12 in a clearance 21 of the housing bore 20 between two seals 19 on the circumference of the supporting piston 7.1. The seals 19 delimit the clearance 21 and act between the housing 12 and the supporting piston 7.1. A pressure chamber 16 which communicates with a hydraulics supply connector 14 in the housing 12 is configured on the circumference of the collet 17.

The supporting piston 7.1 has a protruding end which bears on an end face of the compression plate 5.1.

In the case of the exemplary embodiment illustrated in FIG. 3, the compression actuator 8.1 is activated by way of the compressed-air supply connector 13. To this end, compressed air which presses the supporting piston 7.1 against the compression plate 5.1 is guided into the air chamber 15, so that the compression plate 5.1 in a bearing position is guided on the end sides 10.1 and 10.2 of the rollers 1.1 and 1.2.

The clamping actuator 9.1 is activated by way of the hydraulics supply connector 14. To this end, a hydraulic liquid under high pressure is directed into the pressure chamber 16, said hydraulic liquid by way of the collet 17 leading to the supporting piston 7.1 being clamped. As soon as the supporting piston 7.1 is clamped by the clamping actuator 9.1 the compression actuator 8.1 is deactivated in that the air supply connector 13 is rendered non-pressurized. The compression plate 5.1 in the side plates 4.1 is now ready for operation.

Only one of the compression plates 4.1 is illustrated in FIG. 3. The compression actuators 8.2 and the clamping actuators 9.2 assigned to the compression plate 4.2 are preferably embodied so as to be identical to the shown exemplary embodiment according to FIG. 3. Synchronous or asynchronous controlling of the compression actuators 8.1 and 8.2 and of the clamping actuators 9.1 and 9.2 is possible herein.

A further exemplary embodiment of the crimping device according to the invention is schematically illustrated in a front view in FIG. 4. The exemplary embodiment according to FIG. 4 is substantially identical to the exemplary embodiment according to FIGS. 1 and 2 so that only the points of differentiation will be explained hereunder in order to avoid repetitions, reference otherwise being made to the afore-mentioned description.

In the case of the exemplary embodiment illustrated in FIG. 4, separate rotary drives 22.1 and 22.2 are assigned to the compression plates 5.1 and 5.2 that bear on the end sides of the rollers 1.1 and 1.2. The rotary drives 22.1 and 22.2 are connected to a control installation 11. The control installation is also connected to the compression actuators 8.1 and 8.2 as well as to the clamping actuators 9.1 and 9.2 so as to guide and fix the compression plates 5.1 and 5.2 to or in the respective bearing position at the beginning of the process. As soon as the compression plates 5.1 and 5.2 are fixed in the bearing position, the rotary drives 22.1 and 22.2 are activated by way of the control apparatus 11 so as to rotate the compression plates 5.1 and 5.2 relative to the end sides 10.1 and 10.2 of the rollers 1.1 and 1.2.

In order for the compression plates 5.1 and 5.2 to be driven for the rotating movement, the supporting pistons 7.1 and 7.2, which interact with the compression actuators 8.1 and 8.2 and the clamping actuators 9.1 and 9.2, are embodied in two parts. Each of the supporting pistons 7.1 and 7.2 at the end that faces the compression plates 5.1 and 5.2 has a shaft portion 23.1 and 23.2 which is held so as to be rotatable on the supporting piston 7.1 and 7.2. To this end, the rotary drives 22.1 and 22.2 act on the shaft portions 23.1 and 23.2 of the supporting pistons 7.1 and 7.2. The shaft portions 23.1 and 23.2 are connected in a rotationally fixed manner to the respective compression plate 5.1 and 5.2, the two latter preferably being embodied in a form-fitting manner.

The exemplary embodiment illustrated in FIG. 4 thus has the particular advantage that the position of the compression plates 5.1 and 5.2 relative to the end sides 10.1 and 10.2 of the rollers 1.1 and 1.2 varies. A homogenization of the load of the compression plates 5.1 and 5.2 is thus achieved. The rotary drives 22.1 and 22.2 can be embodied by electric, hydraulic, or pneumatic means.

A further exemplary embodiment of the crimping device according to the invention is schematically shown in a fragment illustration in FIG. 5. The exemplary embodiment illustrated in FIG. 5 is identical to the exemplary embodiment shown in FIG. 3 so that reference is initially made to the afore-mentioned description and otherwise only the points of differentiation are explained. The components of identical function have of course been given identical reference signs.

In the case of the exemplary embodiment illustrated in FIG. 5, the compression actuators and the clamping actuators are in each case integrated so as to form one functional unit. The functional unit herein acts on a supporting piston 7.1 which is guided in a housing 12. A shaft portion 23.1 which by way of a mounting 27 is held on the supporting piston 7.1 is configured on the protruding end of the supporting piston 7.1. The mounting 27 between the shaft portion 23.1 and the supporting piston 7.1 is configured in such a manner that an axial force is transmitted without impediment to the shaft portion 23.1. The shaft portion 23.1 by way of the free end thereof is coupled in a form-fitting and rotationally fixed manner to the compression plate 5.1.

In order for the shaft portion 23.1 and thus the compression plate 5.1 to be rotated, a worm gear 24 which by way of a worm shaft 25 is connected to a toothing on the shaft portion 23.1 is provided. The worm shaft 25 is driven in a rotating manner by a drive 26. The drive 26 here is only schematically illustrated and could be embodied, for example, by electric, pneumatic, or hydraulic means. A drive of the shaft portion 23.1 can thus already be implemented in an hydraulic manner such that the worm shaft 25 is driven in oscillating manner by way of a hydraulic actuator, for example. The connection between the shaft portion 23.1 and the worm gear 24 herein has a free-wheeling feature so that the rotating movement of the worm shaft 25 is transmitted to the shaft portion 23.1 only in one rotation direction.

The functionality herein is identical to that of the aforementioned exemplary embodiment according to FIG. 4. As soon as the compression plate 5.1 in the bearing position thereof on the end sides 10.1 and 10.2 of the rollers 1.1 and 1.2 is positioned and fixed by the compression actuator and the clamping actuator, the drive 26 is activated by the control apparatus not illustrated here. To this extent, the compression plate 5.1 carries out a movement relative to the rollers 1.1 and 1.2.

The crimping device according to the invention is preferably used in a plant for the production of staple fibres by means of which staple fibres of very high quality are capable of being produced without frictional wear by virtue of the advantages of the tightness of the sealing gaps.

The invention claimed is:

1. A method for operating a crimping device having two driven rollers by way of which a fibre strand is conveyed through a roller gap into a stuffer box and in which the roller gap at end sides of the rollers is sealed by a first compression plate and a second compression plate, wherein the first compression plate and the second compression plate at the start of a process are, for a time, actively pressed onto the end sides of the rollers and upon reaching a bearing position are in each case held by a radially acting clamping force, wherein a compression actuator and a clamping actuator act on a supporting piston which bears on an end side of one of the compression plates.

2. The method according to claim 1, wherein each of the compression plates by way of the radially acting clamping force is clamped in such a manner that a respective compression plate remains in the bearing position when the crimping device is in operation.

3. The method according to claim 1, wherein each of the compression plates is in each case connected to a respective rotary drive and in the bearing position carries out a superimposed rotation relative to a respective end side of the rollers.

4. The method according to claim 1, wherein the first compression plate by way of a pneumatically generated compression force is pressed axially onto first end sides of the rollers and the second compression plate by way of a pneumatically generated compression force is pressed axially onto second end sides of the rollers.

5. The method according to claim 1, wherein each of the compression plates is clamped radially in the bearing position and the clamping force is generated hydraulically.

6. A crimping device for crimping a fibre strand, having at least two driven rollers which therebetween form a roller gap, having a stuffer box that is assigned to the roller gap, and having a first compression plate and a second compression plate which for sealing the roller gap bear on end sides of the rollers, the first compression plate and the second compression plate both having a respective compression actuator for pressing on the compression plates, wherein the first compression plate and the second compression plate both additionally have a respective clamping actuator for clamping the compression plates, and in that at least one control apparatus for controlling both the compression actuators and the clamping actuators is provided, the at least one control apparatus is configured so that the compression plates at the start of a process are briefly actively pressed onto the end sides of the rollers and upon reaching a bearing position are in each case held by a radially acting clamping force, and one of the compression actuators is configured to act axially and one of the clamping actuators is configured to act radially on a respectively assigned supporting piston which bears on one of the compression plates.

7. The crimping device according to claim 6, wherein the compression plates are capable of being pressed to their respective bearing position at the end sides of the rollers by, for a time, activating the compression actuators.

8. The crimping device according to claim 7, wherein the compression plates while the crimping device is in operation are capable of being held in the bearing positions by activating the clamping actuators.

9. The crimping device according to claim 6, wherein each of the compression plates is in each case additionally assigned one rotary drive, said rotary drives being connected to the at least one control apparatus.

10. The crimping device according to claim 7, wherein supporting pistons have in each case one rotatable shaft portion, said shaft portions being connected in a rotationally fixed manner to the compression plates and being coupled to the rotary drives.

11. The crimping device according to claim 10, wherein the compression actuators are connected to a compressed-air supply, and the clamping actuators are connected to a hydraulics supply.

12. The crimping device according to claim 11, wherein the compression actuators and the clamping actuators are configured so as to be integrated in one housing.

13. A crimping device for crimping a fibre strand, having at least two driven rollers which therebetween form a roller gap, having a stuffer box that is assigned to the roller gap, and having a first compression plate and a second compression plate which for sealing the roller gap bear on end sides of the rollers, the first compression plate and the second compression plate both having a respective compression actuator for pressing on the compression plates, wherein the first compression plate and the second compression plate both additionally have a respective clamping actuator for clamping the compression plates, and in that at least one control apparatus for controlling both the compression actuators and the clamping actuators is provided, and one of the compression actuators is configured to act axially and one of the clamping actuators is configured to act radially on a respectively assigned supporting piston which bears on one of the compression plates.

* * * * *